US008161571B1

(12) United States Patent
Beaupain

(10) Patent No.: US 8,161,571 B1
(45) Date of Patent: Apr. 24, 2012

(54) INFLATABLE NURSING BIB

(76) Inventor: Cathy Beaupain, Hawthorne, CA (US)

( * ) Notice: Subject to any disclaimer, the term of this patent is extended or adjusted under 35 U.S.C. 154(b) by 0 days.

(21) Appl. No.: 12/858,946

(22) Filed: Aug. 18, 2010

(51) Int. Cl.
*A41B 13/10* (2006.01)

(52) U.S. Cl. ..... 2/49.1; 2/46; 2/DIG. 3

(58) Field of Classification Search ..... 2/48, 49.1–49.5, 2/51, 52, 46, 111, DIG. 3, 455, 463, 464, 2/465, 104, 92; 248/102, 103, 104, 106, 248/105; 5/603, 644, 655.3; 128/845; 602/13
See application file for complete search history.

(56) References Cited

U.S. PATENT DOCUMENTS

| | | | | | |
|---|---|---|---|---|---|
| 1,673,636 | A | * | 6/1928 | Hough | 267/117 |
| 2,134,746 | A | | 11/1938 | Allen | |
| 2,344,255 | A | * | 3/1944 | Lichter | 248/106 |
| 2,451,718 | A | * | 10/1948 | Corrao | 248/105 |
| 2,510,953 | A | | 6/1950 | Brose et al. | |
| 2,526,121 | A | | 10/1950 | Curry et al. | |
| 2,612,645 | A | * | 10/1952 | Boland | 5/644 |
| 2,631,288 | A | | 3/1953 | Daust | |
| 2,766,455 | A | * | 10/1956 | Klaine | 2/49.5 |
| 3,283,343 | A | * | 11/1966 | Worcester | 5/644 |
| 3,308,489 | A | * | 3/1967 | Winkler | 5/648 |
| 211,435 | A | | 6/1968 | Kausen | |
| 3,503,084 | A | * | 3/1970 | Meinwieser | 5/630 |
| 3,568,227 | A | * | 3/1971 | Dunham | 5/655.3 |
| 3,863,343 | A | * | 2/1975 | Malmin | 433/229 |
| 3,905,571 | A | * | 9/1975 | Lombardo | 248/102 |
| 4,528,705 | A | * | 7/1985 | Greenawalt | 5/644 |
| 4,895,327 | A | | 1/1990 | Malone et al. | |
| 5,022,616 | A | | 6/1991 | Kordecki | |
| 5,184,796 | A | | 2/1993 | Maher | |
| 5,218,721 | A | * | 6/1993 | Mathews et al. | 2/49.2 |
| D379,660 | S | * | 6/1997 | Aube | D24/199 |
| 5,765,225 | A | * | 6/1998 | Goeckeritz et al. | 2/49.1 |
| D403,489 | S | * | 1/1999 | Cameron | D2/864 |
| 6,055,667 | A | | 5/2000 | Jimenez | |
| 6,082,681 | A | * | 7/2000 | Rand | 248/102 |
| 6,098,934 | A | | 8/2000 | Skelton | |
| D432,759 | S | | 10/2000 | Krolczyk et al. | |
| 6,131,219 | A | * | 10/2000 | Roberts | 5/644 |
| 6,592,084 | B1 | * | 7/2003 | Nile | 248/104 |
| 6,659,552 | B2 | * | 12/2003 | Duncan | 297/230.1 |
| 6,708,355 | B1 | * | 3/2004 | Wang et al. | 5/644 |
| 6,892,406 | B2 | * | 5/2005 | Littlehorn | 5/639 |
| 6,961,961 | B1 | | 11/2005 | Ezra | |
| 2004/0216208 | A1 | * | 11/2004 | Austin | 2/49.1 |

* cited by examiner

*Primary Examiner* — Amy Vanatta
(74) *Attorney, Agent, or Firm* — Gene Scott; Patent Law & Ventrue Group

(57) ABSTRACT

An inflatable nursing bib has an air tight bladder of a flexible, impermeable sheet material. The bladder has an upper and a lower mutually convergent panels peripherally joined by a side panel. An interior partition is joined with the upper and lower panels and is sized, shaped and positioned to secure a concave depression in the upper panel. A fabric jacket is fitted over the bladder. A strap is used to secure a baby bottle in place on top of the upper panel whereby the bottle is oriented in a nipple-down attitude. Opposing flaps extend from the jacket to secure the bib around a baby's neck.

6 Claims, 5 Drawing Sheets

INFLATABLE NURSING BIB

BACKGROUND

The presently described inflatable nursing bib is related to baby bibs and similar items worn by babies during feeding to keep food drips from soiling and wetting baby's clothing. Traditional items of this kind are not particularly useful for solving other problems related to feeding and especially bottle feeding of infants. One problem with bottle feeding is that an adult is required to hold the bottle steady for the entire time while feeding the baby. In particular, the bottle must be held in a nipple-down attitude to prevent the baby from ingesting air. This results in hand fatigue and inconvenience to the adult. A further problem is that some of the liquid from the bottle may drip down baby's neck causing discomfort to baby and interrupting the feeding. A still further problem is that when a bottle is simply propped-up using, for instance, a baby blanket or pillow, baby's movements during feeding typically will cause the bottle to roll away from baby's mouth, so that the baby will cry out. A yet further problem is that when a traditional bib is used during baby feeding, baby's motions may cause the bib to be dislodged so that spills are able to dampen or wet baby's clothing. The presently described apparatus overcomes these and related problems as described in the following summary.

SUMMARY

A baby bib may be constructed using an inflatable plastic inner bladder engaged within an outer jacket of a soft and absorbent material. The bib may be configured to cover the front of a baby and attached about the baby's neck. The inflatable bladder may be made of portions of plastic sheeting joined by heat bonding to form leak-proof seams to achieve a desired form or shape. Instead of a separate outer jacket, the bladder may have an absorbent material laminated on its outer to absorb spills. The apparatus may have an elastic strap to hold a baby bottle in a fixed position on top of the bib during nursing. The apparatus may have a further strap engaging a baby's legs or torso to hold the apparatus in place on top of the baby during nursing. A concave portion of the apparatus may be used to maintain the baby bottle in place and to function equally well for small as well as large diameter bottles. The apparatus may use a sloped top surface to hold the bottle in a nipple-down attitude so as to gravity feed the liquid to the baby.

These and other aspects may, in various implementations, provide one or more of the following advantages.

The apparatus is able to secure a baby bottle in place on a bib surface held in place on a reclining baby.

The apparatus is able to position the baby bottle in a nipple-down attitude to assure gravity feed of liquid flow to the nipple until the bottle has been drained.

The apparatus is able to be quickly inflated by mouth or a hand pump.

The apparatus is able to be deflated into a flat configuration which can be folded for compact storage.

The apparatus is able to be secured to a baby during feeding.

The apparatus is able to feed a baby without adult manual effort or attention.

The details of one or more embodiments of these concepts are set forth in the accompanying drawings and the description below. Other features, objects, and advantages of these concepts will be apparent from the description and drawings, and from the claims.

DESCRIPTION OF DRAWINGS

Like reference symbols in the various drawings indicate like elements.

DETAILED DESCRIPTION

Figure 1:
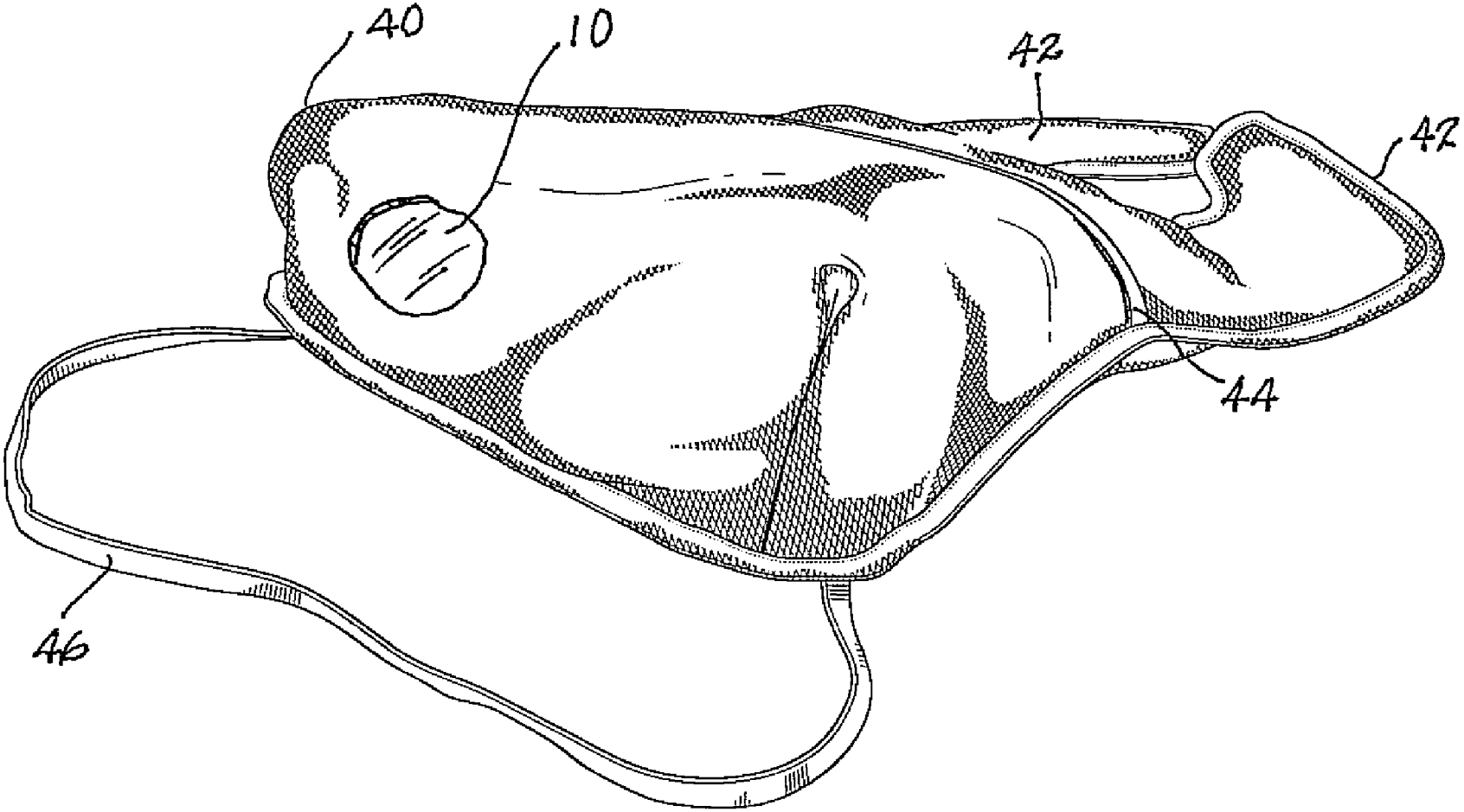
FIG. 1 is a perspective view of an outer jacket or bladder covering of the presently described apparatus as viewed from a bottom-right side thereof.
Figure 5:
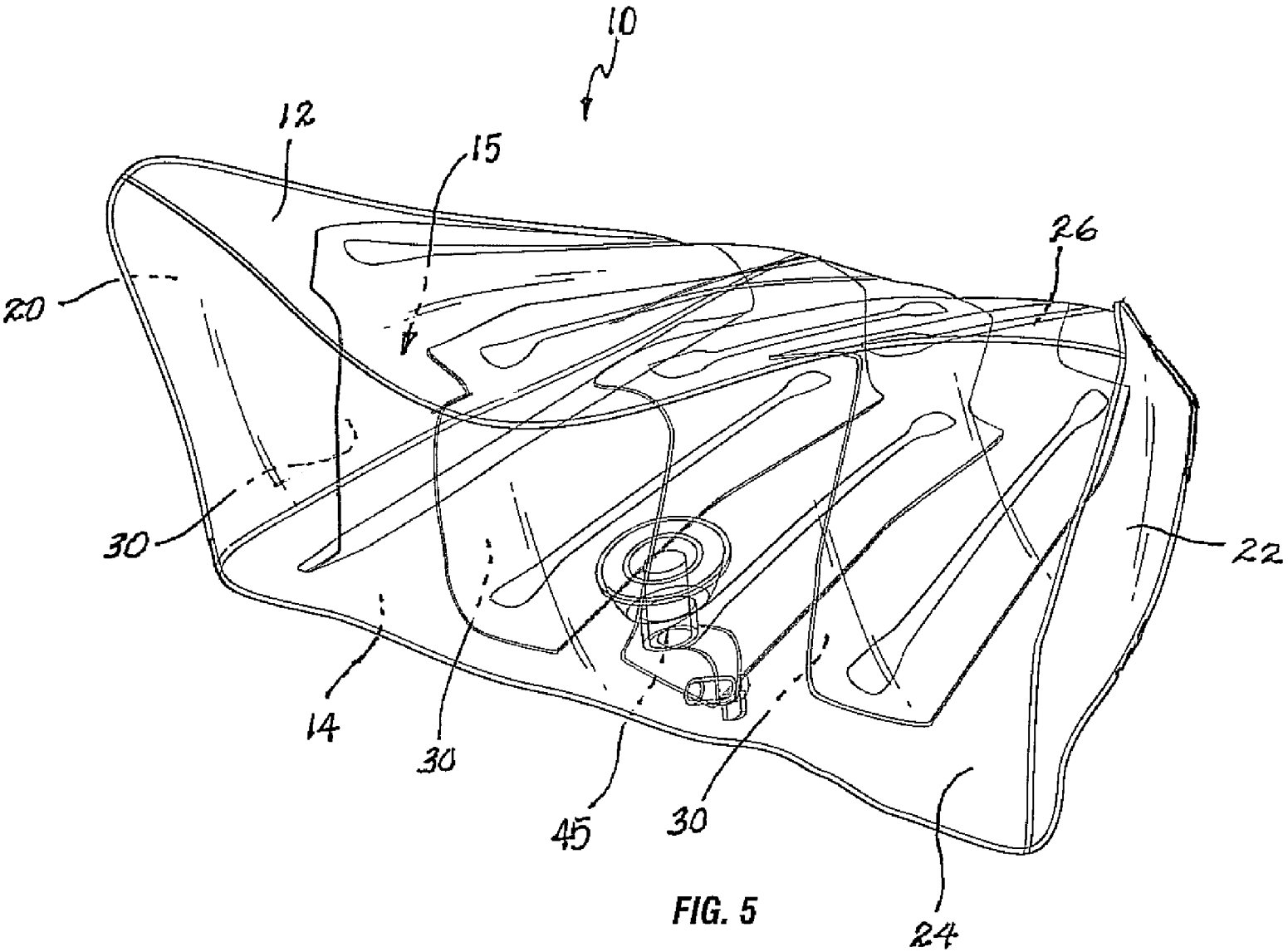
FIG. 5 is a perspective view as seen from bottom right of an inflated bladder thereof, as removed from the outer jacket of the apparatus.

FIG. 1 illustrates an inflatable nursing bib, the apparatus of the present description. The bib may have an inflatable bladder 10 as shown in FIG. 5. The bladder 10 may be fabricated from a flexible and impermeable sheet material such as polyethylene, polyester, polypropylene or other thin-walled plastic sheeting, preferably 1-3 mils in thickness. As shown, the bladder 10 has an upper panel 12 and an opposing lower panel 14. The upper and lower panels are mutually joined by side panels which extend fully around the bladder 10, thereby enclosing an interior volume 15 within the bladder 10. The side panels encompassing a left side 20, a right side 22, a bottom side 24 and a top side 26 of the bladder 10. One or more interior partitions 30 extend, in an upright manner, between the upper 12 and the lower 14 panels. The interior partitions 30 have a height 32 less than the left side 20 and the right side 22 thereby forming an elongated depression or concavity 12C (FIG. 2) in the upper panel 12. The concavity 12C may be centered on the upper panel 12 and may be extensive between the top side 26 and the bottom side 24. The partitions may be one or more strips of plastic, or other materials and may take any shape as long as they draw the upper panel 12 into the relative depression (concavity 12C) which is best shown in FIGS. 2 and 5.

Figure 2:
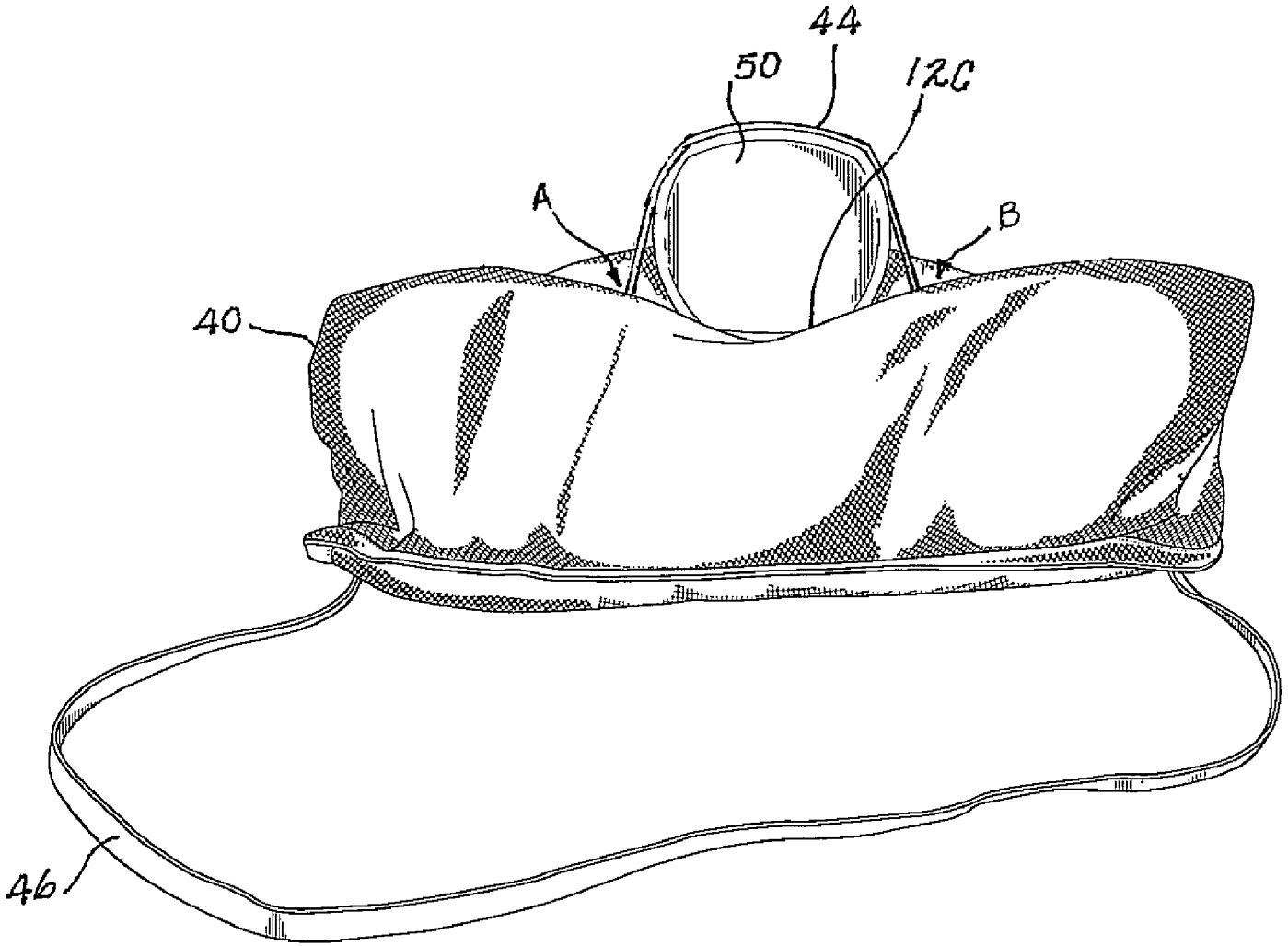
FIG. 2 is a bottom elevational view thereof with the apparatus shown supporting a bottle for nursing a baby.
Figure 3:
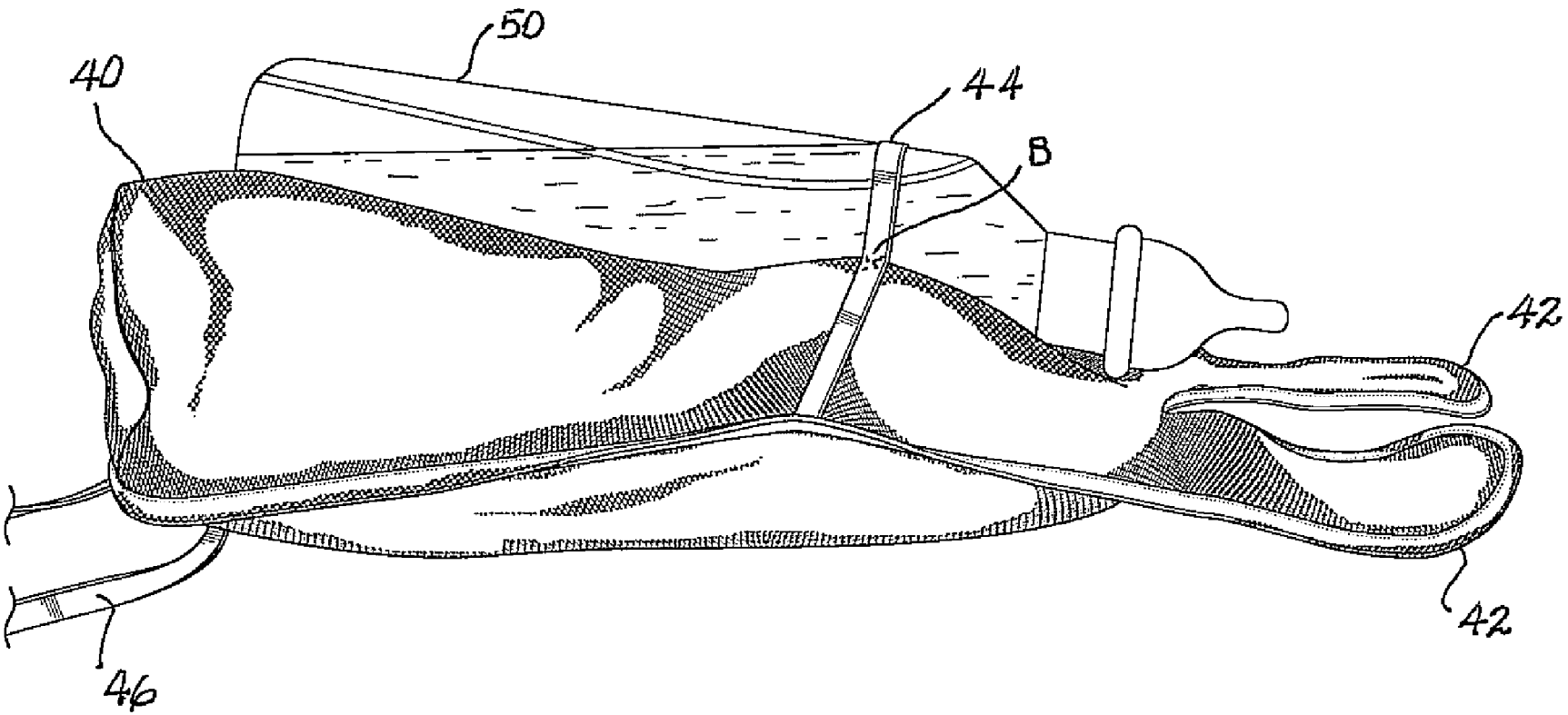
FIG. 3 is a side elevational view thereof with the baby bottle shown in a position ready for feeding a baby.
Figure 4:
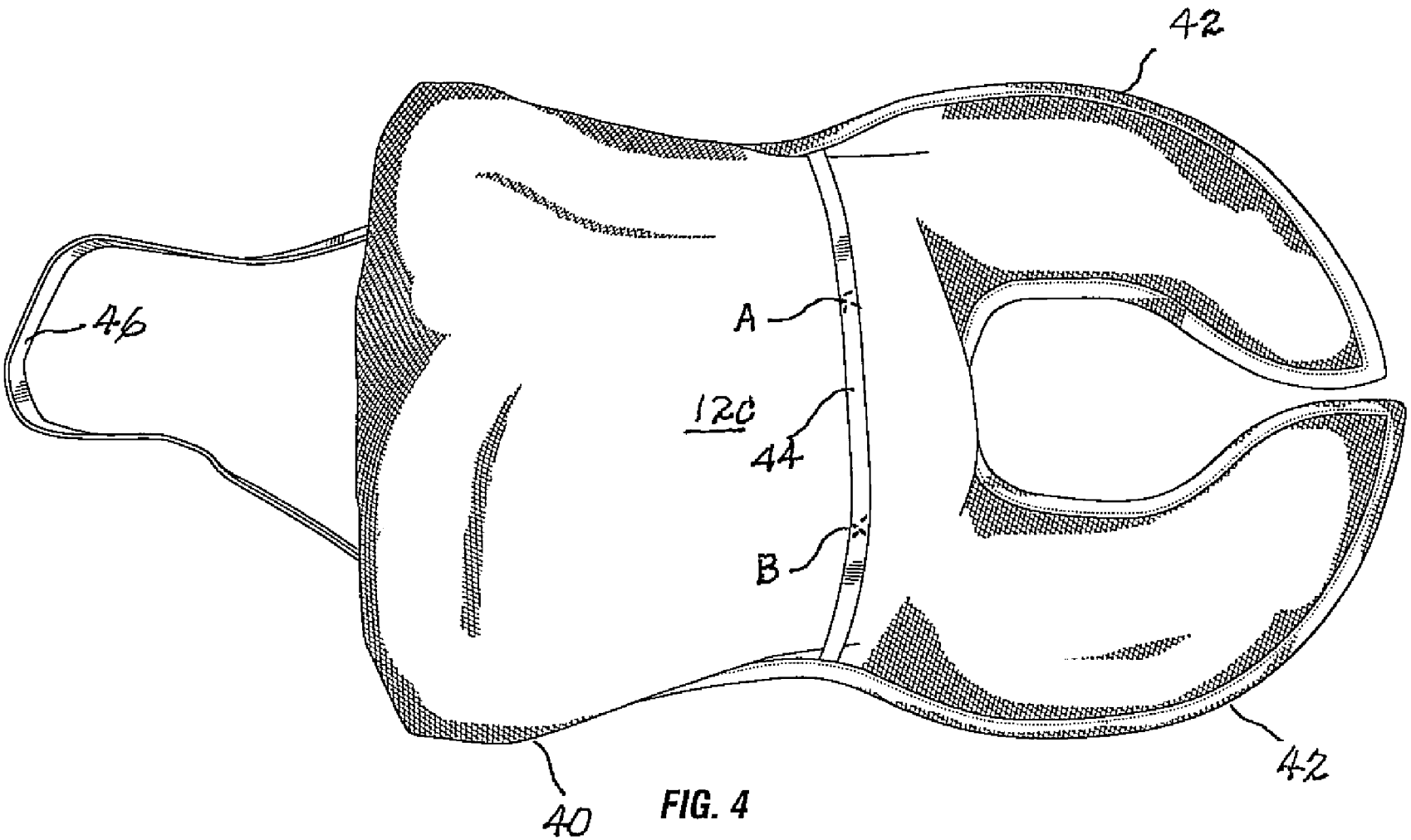
FIG. 4 is a top plan view thereof.

As shown in FIGS. 1-4, the bib may include a separate jacket 40 shaped to totally cover the exterior surface of the fully inflated bladder 10 and to follow its contours exactly so that the jacket 40 may fit the bladder 10 like a glove. This is clearly shown in FIGS. 3 and 4. Instead of a separate jacket 40, the plastic sheet panels 12, 14, 20, 22, 24 and 26 of the inflatable bladder may be bonded or otherwise intimately covered by a soft and absorbent material such as a thin layer of fabric on the bladder's exterior surface. FIGS. 1-4 serve to also illustrate this alternative embodiment. The jacket 40 may be made of a soft and absorbent fabric sewn into the shape illustrated in the attached drawings, so that it may function as a protective garment in a manner similar to traditional cloth bibs. The jacket 40 may have a pair of opposing fabric neck flaps 42 attached to and extensive away from the top of the jacket 40 as best seen in FIG. 4. The neck flaps 42 may have a fastener system, not shown, such as Velcro® attached thereto so that they may be secured around a babies neck. The neck flaps 42 may be mutually convergent as shown in FIG. 4 to more effectively fit the baby's contour so as to fit snugly.

As best seen in FIGS. 2, 3 and 4, the bib may have an elastic bottle strap 44 fastened medially to the jacket 40 on its sides and extensive laterally above the jacket 40 as shown in FIG. 2, across the upper panel 12 of the bladder. As shown in FIG. 2, strap 44 holds a baby bottle 50 against the upper surface of the jacket 40 and within the concave depression. As seen in FIG. 4, strap 44 is secured to the surface of jacket 40 at points "A" and "B" by stitching or equivalent means so that bottle 50 is tightly held against the surface of jacket 40 and cannot roll laterally, move longitudinally, or be angularly dislodged. As best seen in FIGS. 1 and 2, the bib may also have a leg strap 46 fastened to the jacket 40 and extensive laterally across the lower portion of the jacket 40. The leg strap 46 may have sufficient slack for securing it around a babies legs during nursing so as to secure the bib in place resting on the front of the baby's abdomen with the baby in a reclined position.

Referring now again to FIG. 5, the bottom side 24 is taller than the top side 26 so that the upper panel 12 slants downwardly from the bottom side 24 toward the top side 26 converging on the top side 26. The similarly contoured jacket also has this same conformation so that the bottle 50 takes a nipple-down attitude for gravity feed of liquid as shown in FIG. 3. A valve 45 is secured to one or more of the panels of the bladder for inflating and deflating the bladder 10. A slit (not shown) in the jacket 40 provides access to the valve 45. The bladder 10 may be permanently secured within the jacket 40, or an entry may be provided in the jacket 40 for the bladder 10 to be inserted or removed.

Embodiments of the apparatus have been described. Nevertheless, it will be understood that various modifications may be made without departing from the spirit and scope of this disclosure. Accordingly, other embodiments are within the scope of the following claims.

What is claimed is:

1. An inflatable nursing bib comprising:

an air tight bladder of a flexible, impermeable sheet material, the bladder having an upper and a lower mutually facing, convergent panels extending between a bottom side and a top side of the bib, the convergent panels peripherally joined by a side panel having a left side and a right side, the left and right side panels diminishing in height between the bottom and the top side of the bib;

an interior partition extensive between the bottom and the top sides of the bib and joined with, and extending between, the upper and lower panels, the partition directionally aligned with the left and right side panels;

the left and right sides of the side panel and the partition each correspondingly diminishing in height between the bottom and the top side of the bib, thereby establishing the convergence of the upper and lower panels and forming an elongated concave depression in the upper panel, the depression having a shape and a depth as to cause a baby bottle laid thereon, and in alignment therewith, to move to a central position on the bib; and an absorbent layer bonded to an exterior surface of the bladder in conformity therewith.

2. The bib of claim 1 further comprising a pair of opposing neck flaps enabled for securing the bib to a baby's neck.

3. The bib of claim 1 further comprising a first strap fastened to the bib and extensive laterally above the upper panel in a configuration enabled for elastically securing a baby bottle supported by the bib at the concave depression.

4. The bib of claim 3 further comprising a second strap fastened to the bib and extensive laterally across the lower panel in a configuration enabled for securing the bib to a baby.

5. The bib of claim 1 wherein the interior partition includes at least two partition portions set in parallel spaced apart positions.

6. The bib of claim 1 further comprising an inflation valve engaged with one of the panels.

* * * * *